United States Patent [19]

Washio et al.

[11] 3,947,114

[45] Mar. 30, 1976

[54] ELECTROSTATIC COPYING MACHINE

[75] Inventors: Takaji Washio, Toyonaka; Koichi Sasaki, Sakai; Kazumi Iida, Neyagawa; Masahide Iseki, Kyoto; Tatsuo Aizawa, Osaka, all of Japan

[73] Assignee: Mita Industrial Company Limited, Osaka, Japan

[22] Filed: July 12, 1974

[21] Appl. No.: 488,062

[30] Foreign Application Priority Data

July 17, 1973 Japan ..... 48-81061

[52] U.S. Cl. ..... 355/4; 355/35

[51] Int. Cl.[2] ..... G03G 15/01

[58] Field of Search ..... 355/4, 35–38; 346/74 EK; 96/1.2

[56] References Cited

UNITED STATES PATENTS

| | | | |
|---|---|---|---|
| 2,521,954 | 9/1950 | Tuttle et al. | 355/36 |
| 2,921,498 | 1/1960 | Simmon et al. | 355/36 |
| 3,117,488 | 1/1964 | Giordano | 355/4 |
| 3,420,151 | 1/1969 | Levine | 355/4 |
| 3,467,468 | 9/1969 | Johnson | 355/4 |
| 3,531,195 | 9/1970 | Tanaka et al. | 355/4 |
| 3,532,422 | 10/1970 | McFarlane | 355/4 |
| 3,848,990 | 11/1974 | Otubo et al. | 355/4 |

*Primary Examiner*—Joseph W. Hartary
*Attorney, Agent, or Firm*—Diller, Brown, Ramik & Wight

[57] ABSTRACT

A versatile electrostatic copying machine which can provide not only ordinary black-and-white and monochromatic copies and ordinary multi-colored copies but also artificial monochromatic and multi-colored copies of desired optional colors differing from colors of originals conveniently with ease without such troubles as color mingling and paper jamming is disclosed, said copying machine comprising an original-light exposing zone for irradiating an original to be copied in the stationary or moving state by a light source, a photosensitive layer-light exposing zone for light-exposing imagewise a statically charged photosensitive layer, an optical system for optically connecting said original-light exposing zone to the photosensitive layer-light exposing zone and projecting an image of the original on the photosensitive layer and a development mechanism for developing an electrostatic latent image formed on the photosensitive layer directly or after it has been transferred onto a transfer paper, wherein said optical system comprises a light-selecting mechansim for selecting an optional light from white light and color-separated lights and exposing the photosensitive layer to said selected light and an exposure light quantity-adjusting mechanism for adjusting the exposure light quantity to an optimum quantity with respect to each of a plurality of said lights, the development mechanism comprises a development operation-selecting mechanism for selecting an optional development operation among a plurality of development operations differing in the toner hue, and said light-selecting mechanism and development operation-selecting mechanism are actuated independently or in the state interlocked with each other so that a copy having a desired coloring effect can be obtained.

19 Claims, 21 Drawing Figures

Fig. 2-A
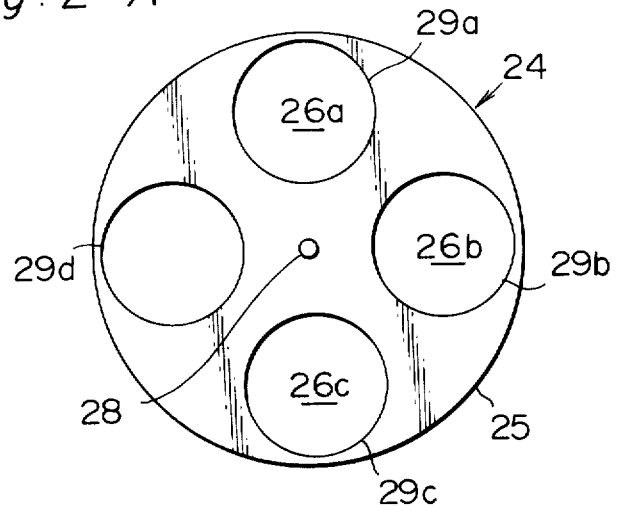
Fig. 2-B
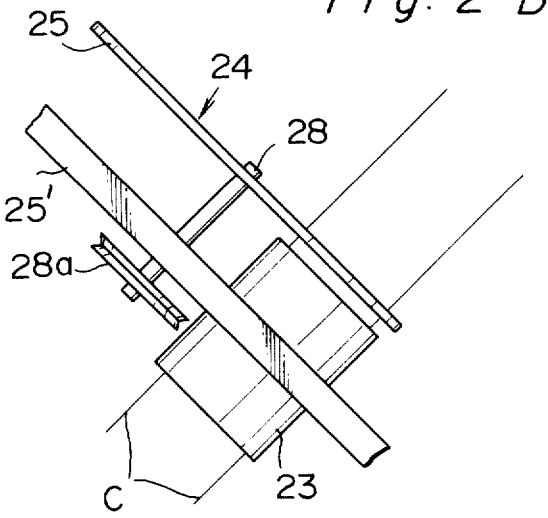

Fig. 3-A
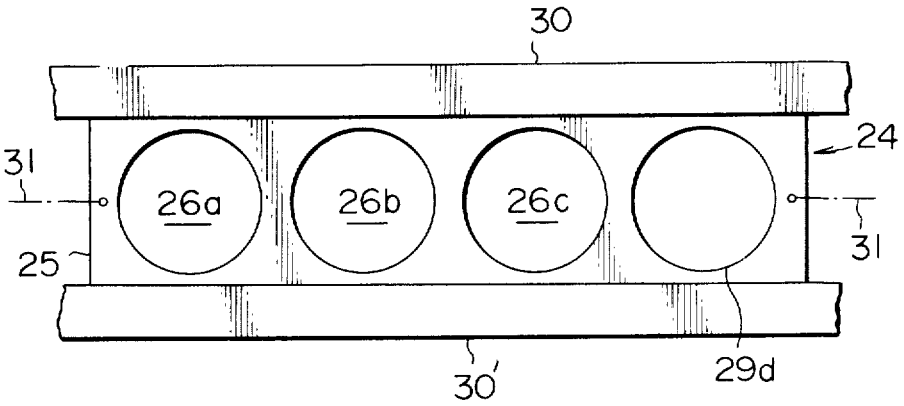
Fig. 3-B
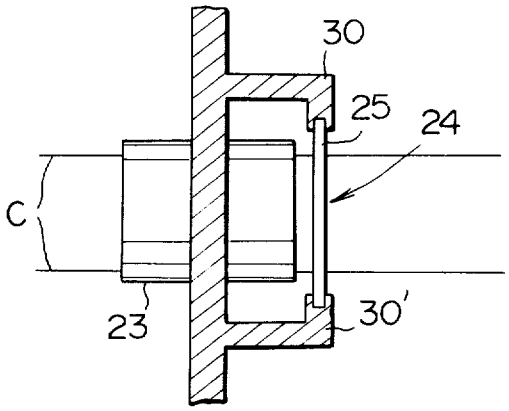

Fig. 4-A
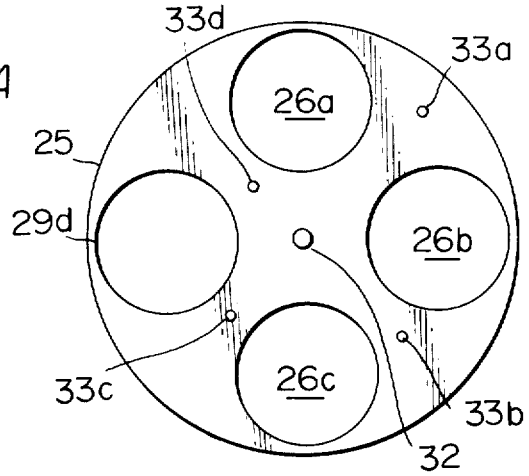
Fig. 4-B
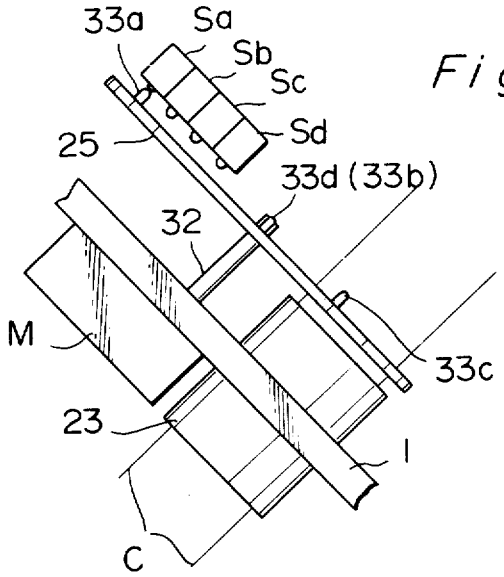

Fig. 5
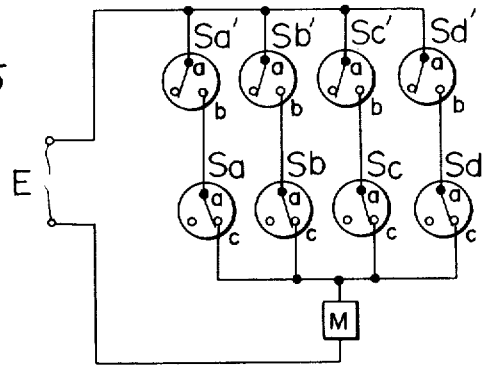
Fig. 6-A
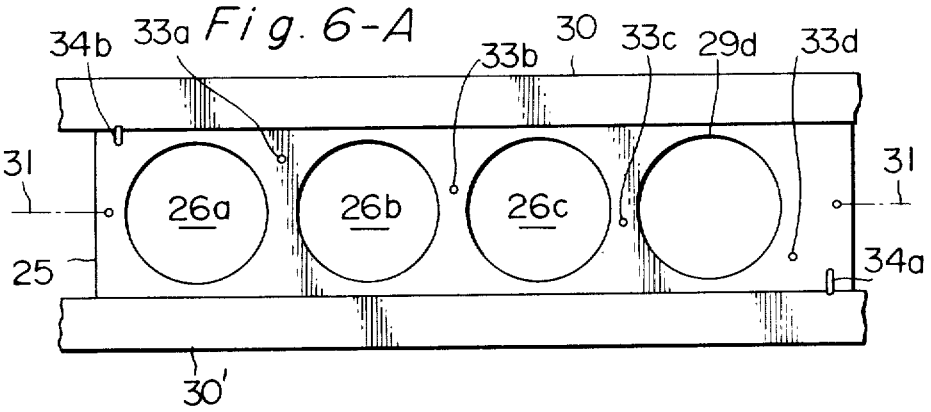
Fig. 6-B
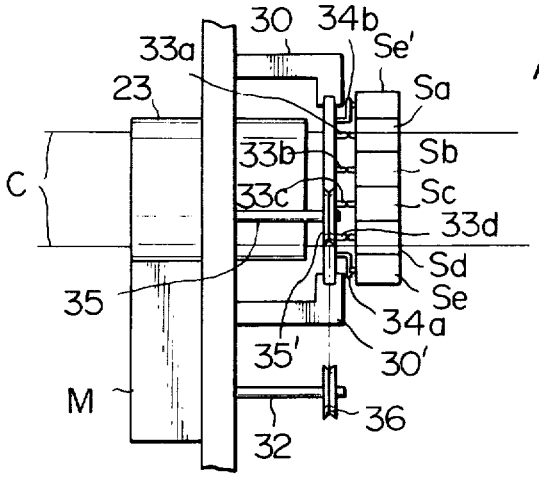

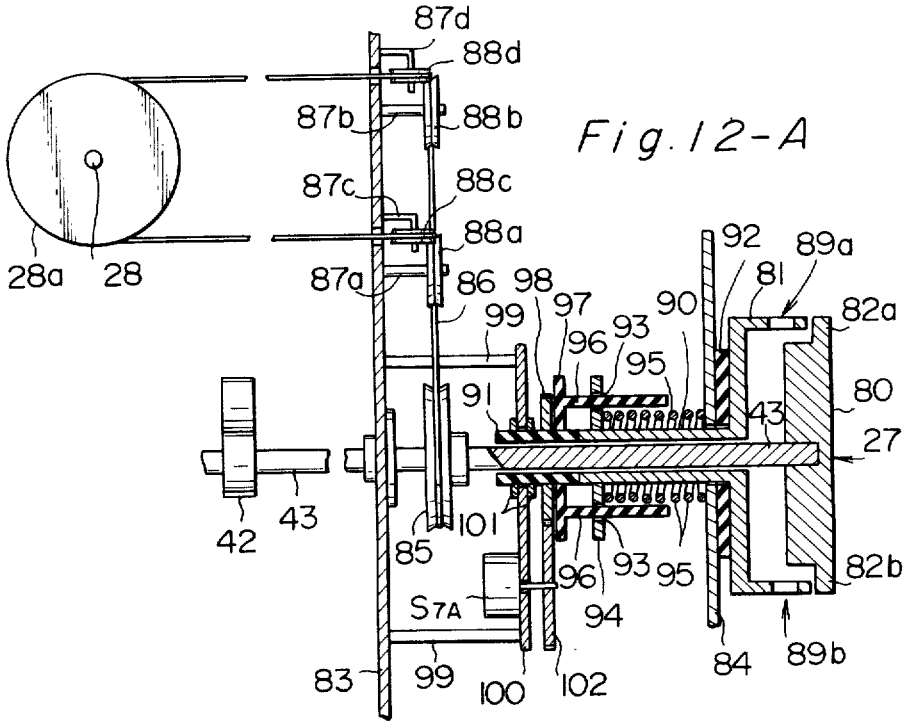
Fig. 12-A
Fig. 12-B
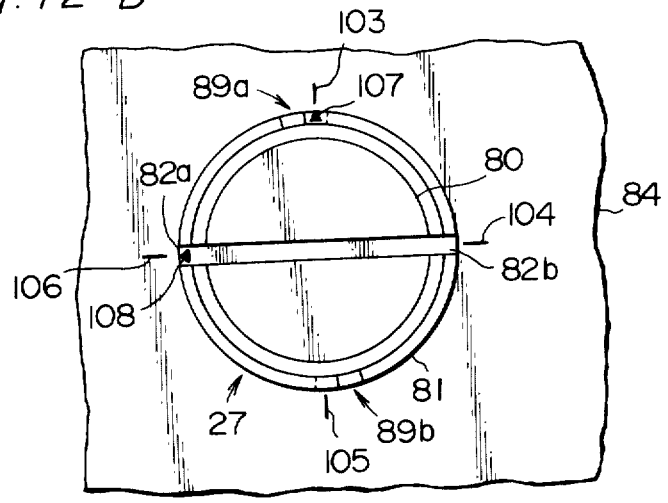

Fig. 12-C
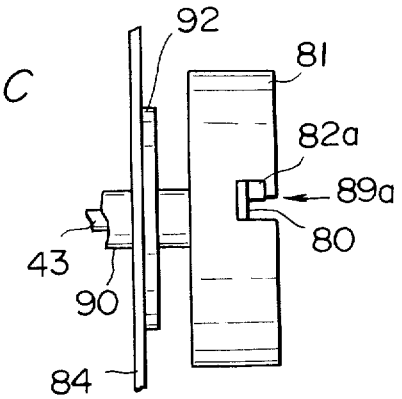
Fig. 12-D
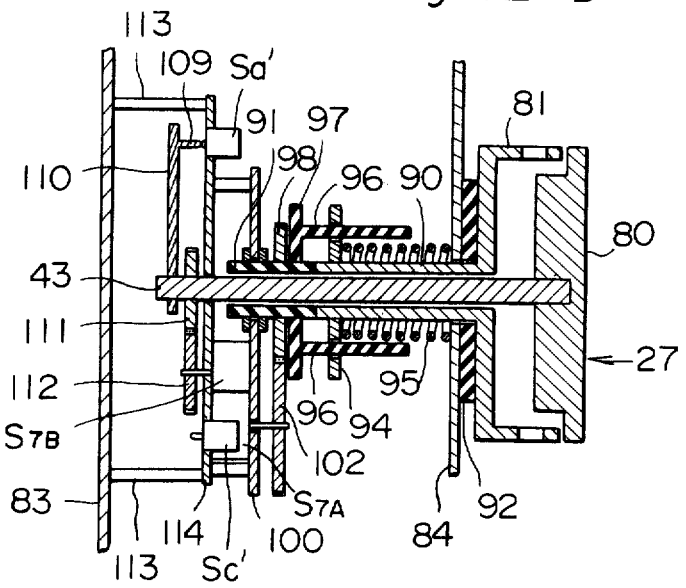

ELECTROSTATIC COPYING MACHINE

This invention relates to a versatile elestrostatic copying machine. More particularly, the invention relates to a versatile electrostatic copying machine which can provide not only a monochromatic copy of an optional hue reproducing the total image areas of an original or an image area of a specific hue selected from the image areas of an original, but also a multicolored copy reproducing in different hues an image area of a specific hue selected from the image areas of an original and another image area of another specific hue selected from the image areas of the original.

In the electrostatic copying process, a photosensitive layer is statically charged and exposed to light imagewise to form an electrostatic latent image, and the electrostatic latent image is developed with charged toner particles directly or after it has been transferred onto a copying paper (transfer paper), to thereby form a visible image.

In an ordinary electrostatic copying machine for office uses, white light is used for the imagewise light exposure and a black-and-white image corresponding to the image of an original is formed. In the field of designing or the like, it is sometimes desired to obtain several kinds of copies differing in the color from one original, and further, in the field of planning or at ordinary offices it is also desired for distribution, preservation, maintenance or other purposes to obtain several kinds of copies differing in the color from one original. It is difficult to adapt conventional electrostatic copying machines for office uses to such demand.

Therefore, various color copying machines of the electrostatic type have heretofore been proposed. In these color copying machines of this type, a charged photosensitive layer is exposed imagewise to color-separated light to form an electrostatic latent image and this latent image formed on the photosensitive layer is developed with a developing toner corresponding with the color-separated light used for exposure, and these steps of charging, imagewise exposure and development are repeated on one photosensitive layer in correspondence with the three primary colors. Accordingly, these color copying machines of the electrostatic type are satisfactory in the point that copies having image areas reproduced in hues substantially identical with hues of corresponding image areas of an original can be obtained. However, these color copying machines have such an operational defect that even when a black-and-white copy is prepared from an original or a monochromatic copy is obtained from a monochromatic image original, the above-mentioned steps of charging, imagewise exposure and development should be repeated three times in respect to the three primary colors as in the use of multicolor reproduction.

Further, these known color copying machines of the electrostatic type cannot be successfully used for attaining the object of obtaining copies of optional hues from a common original.

It is, therefore, a primary object of this invention to provide a versatile electrostatic copying machine which can provide not only a monochromatic copy of an optional hue reproducing the total image areas of an original or an image area of a specific hue selected from the image areas of an original, but also a multicolored copy reproducing in different hues an image area of a specific hue selected from the image areas of an original and another image area of another specific hue selected from the image areas of the original.

Another object of this invention is to provide a versatile electrostatic copying machine, in which in case a black-and-white or other monochromatic copy is prepared, the copying operation is accomplished by conducting one cycle of the charging, imagewise exposure and developing steps, and in case a multi-colored copy is prepared, the copying operation is accomplished by repeating the charging, imagewise exposure and developing steps in a cycle number corresponding to the number of the primary colors to be reproduced.

Still another object of this invention is to provide a versatile electrostatic copying machine which has a relatively simple structure and hence, can be marketed at a relatively low cost.

In accordance with this invention, there is provided a versatile electrostatic copying machine comprising an original-light exposing for irradiating an original to be copied in the stationary or moving state by a light source, a photosensitive layer-light exposing zone for light-exposing imagewise a statically charged photosensitive layer, an optical system for optically connecting said original-light exposing zone to the photosensitive layer-light exposing zone and projecting an image of the original on the photosensitive layer and a development mechanism for developing an electrostatic latent image formed on the photosensitive layer directly or after it has been transferred onto a transfer paper, wherein said optical system comprises a light-selected mechanism for selecting an optional light from white light and color-separated lights and exposing the photosensitive layer to said selected light and an exposure light quantity-adjusting mechanism for adjusting the exposure light quantity to an optimum quantity with respect to each of a plurality of said lights, the development mechanism comprises a development operation-selecting mechanims for selecting an optional development operation among a plurality of development operations differing in the toner hue, and said light-selecting mechanism and development operation-selecting mechanism are actuated independently or in the state interlocked with each other so that a copy having a desired coloring effect can be obtained.

This invention will now be illustrated more detailedly by reference to the accompanying drawing, in which:

FIG. 1 is a view illustrating the arrangement of mechanisms and members in one embodiment of the electrostatic copying machine of this invention;

FIG. 2-A is a front view illustrating an instance of a color-separating mechanism of the copying machine of this invention;

FIG. 2-B is a side view illustrating the state of disposition of the color-separating mechanism of FIG. 2-A on the optical path;

FIG. 3-A is a front view illustrating another instance of the color-separating mechanism;

FIG. 3-B is a side view illustrating the state of disposition of the color-separating mechanism of FIG. 3-A on the optical path;

FIG. 4-A and 4-B illustrate arrangement of switch mechanisms adopted when selection of a color-separating filter in the color-selecting mechanism of FIG. 2-A is performed electrically;

FIG. 5 is an electric circuit diagram for the switch mechanisms of FIG. 4-B;

FIG. 6-A and 6-B illustrate arrangement of switch mechanisms adopted when selection of a color-separating filter in the color-selecting mechanism of FIG. 3-A is performed electrically;

Figure 13:
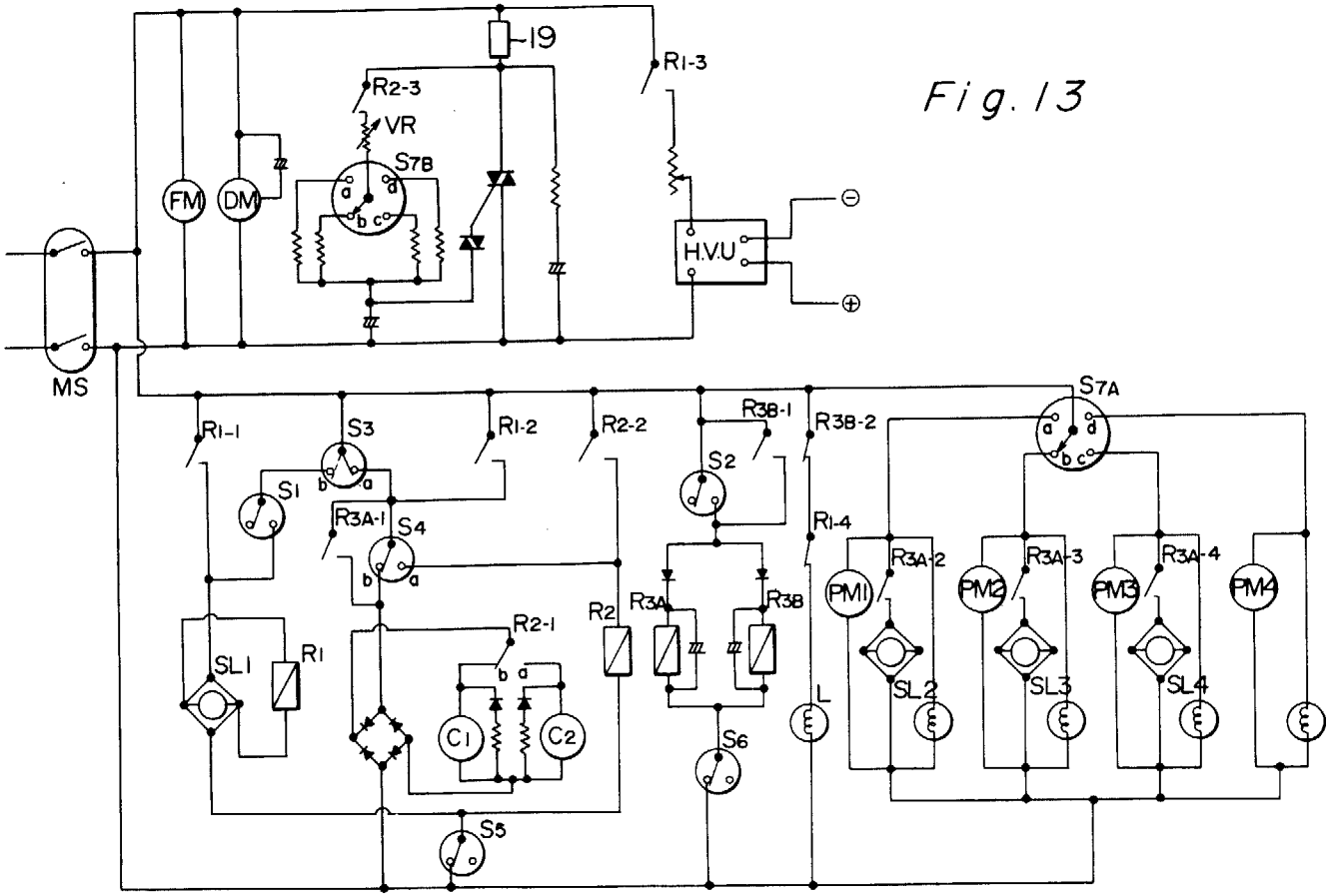
Figure 14:
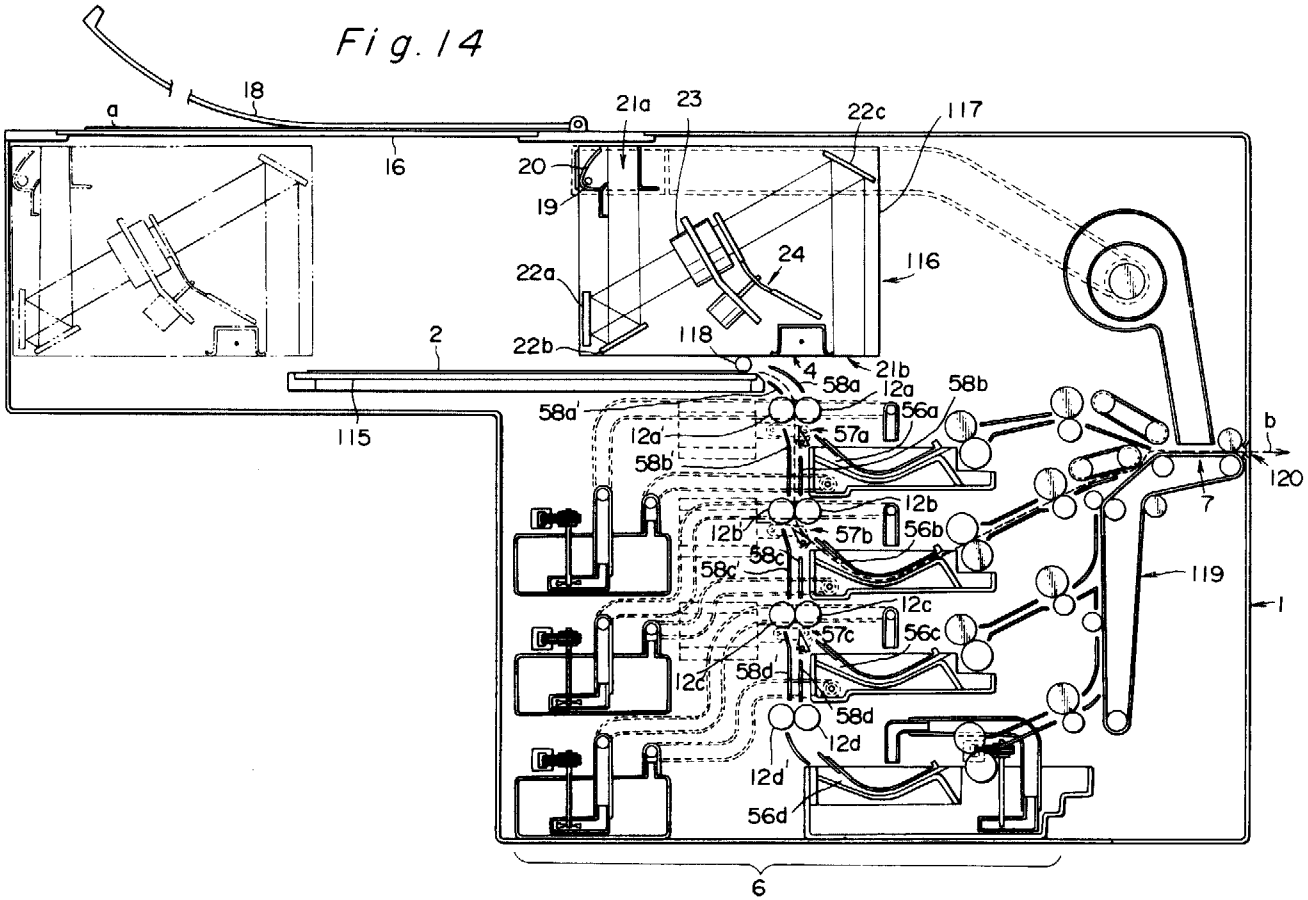

FIG. 12-A is a view illustrating the structure for actuating the light-selecting mechanism, the exposure light quantity-adjusting mechanism and the development passage-selecting mechanism in the state mechanically interlocked with one another;

FIG. 12-B is a front view illustrating a dial member of the structure shown in FIG. 12-A;

FIG. 12-C is a side view showing the dial member illustrated in FIG. 12-A;

FIG. 12-D is a view illustrating the structure for actuating the light-selecting mechanism, the exposure light quantity-adjusting mechanism and the development passage-selecting mechanisms in the state electrically interlocked with one another;

FIG. 13 is an electric circuit diagram for the control system of the electrostatic copying machine of this invention; and FIG. 14 is a diagram illustrating arrangement of mechanisms and members of another embodiment of the electrostatic copying machine of this invention.

Figure 1:
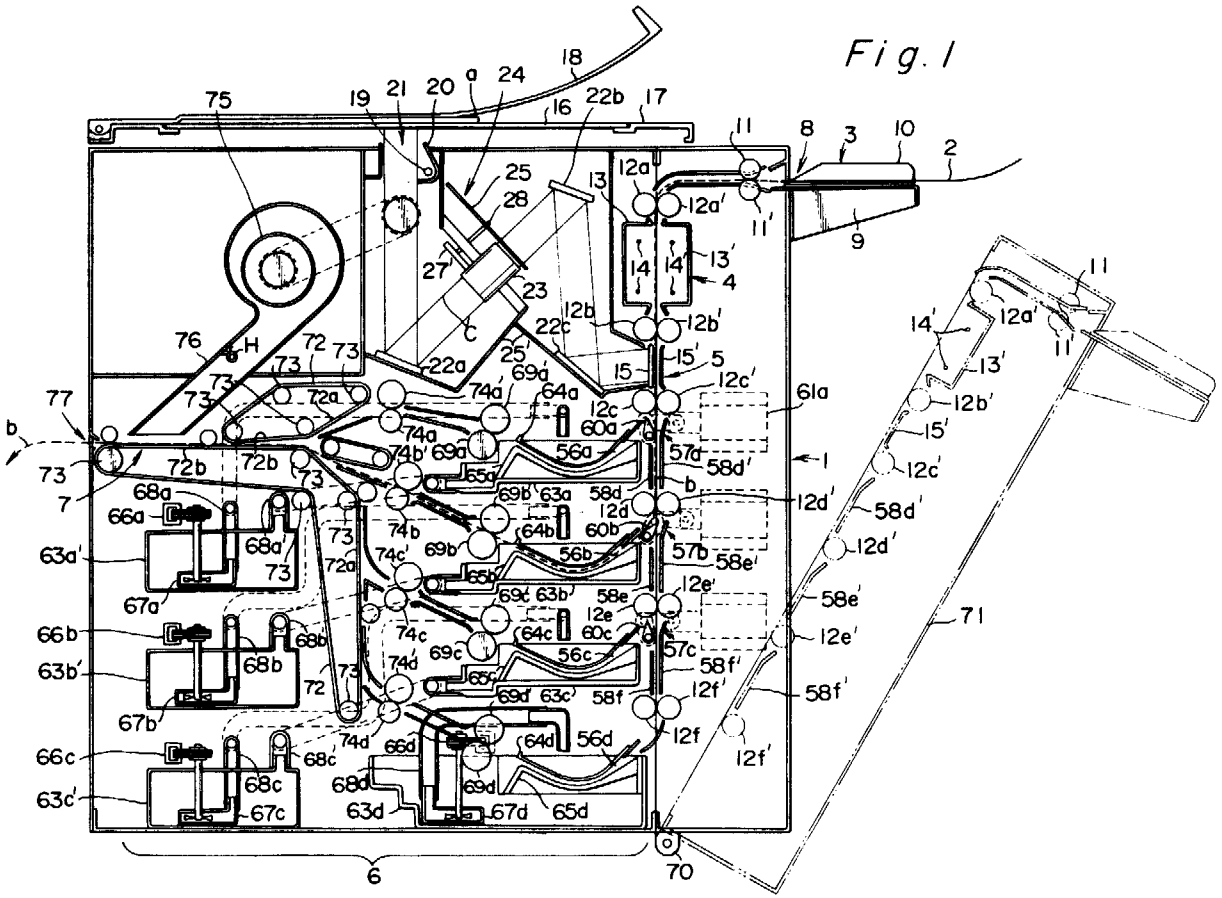

By referring to FIG. 1 showing the outline of arrangement in one embodiment of the electrostatic copying machine of this invention, in the interior of a machine frame 1 a copying paper transfer passage *b* extends for introducing a copying paper 2 from a manual paper-feeding member 3 to a charging device zone 4, a light exposure zone 5, a developing device zone 6 and a drying or fixing device zone 7 successively in order.

A paper-feeding table 9 is disposed outside the machine frame at the point of a manual paper-feeding opening 8 and a side guide plate 10 is disposed slidably in the lateral direction above the paper-feeding table 9 so as to introduce an electrostatic copying paper into the copying paper transfer passage *b* in the position-fixed state. The position of this side guide plate 10 is set to a prescribed point and one or both of side edges of the copying paper 2 are precisely adapted along the side guide plate 10. When the copying paper 2 is inserted into the manual paper-feeding opening 8 in this state, it is made possible to feed the copying paper 2 into the transfer passage *b* in the position-fixed state. A pair of feed rollers 11 and 11' which are perpetually driven are disposed adjacently to the manual paper-feeding opening 8. The charging device zone 4 includes a pair of copying paper transfer driving rollers 12*a* and 12*a'* disposed on the feed side, a pair of copying paper transfer driving rollers 12*b* and 12*b'* disposed on the discharge side, confronting shield cases 13 and 13' disposed betwen the rollers 12*a* and 12*a'* and the rollers 12*b* and 12*b'*, and wire-like charging electrodes 14 and 14' disposed in the shield cases 13 and 13', respectively. The light exposure zone 5 includes a transparent plate 15 for light exposure of a copying paper disposed between said driving rollers 12*b* and 12*b'* and a pair of driving rollers 12*c* and 12*c'*, and a guide plate 15' for guiding a copying paper to the transparent plate 15 and pressing it thereto.

An original-moving frame 17 having a transparent plate 16 for supporting thereon an original *a* to be copied is mounted in the upper portion of the machine frame 1. A pressing plate 18 is disposed on the moving frame 17 to press the original *a* to the transparent plate 16. The moving frame 17 is supported on the upper portion of the machine frame through rotors (not shown) so that it can be moved reciprocatively on a moving passage formed on the upper portion of the machine frame by a drive mechanism capable of driving the frame 17 in two opposite directions. As such drive mechanisms there can be employed a combination of a drive drum driven and rotated in two opposite directions and a wire or a combination of rotors driven and rotated in opposite directions and a clutch.

An optical system for optically connecting the transparent plate 16 of the moving frame 17 with the transparent plate 15 of the light exposure zone of the copying paper transfer passage *b* and focussing an image of the original *a* on the charged copying paper is disposed between the moving passage for the moving frame 17 and the copying paper transfer passage *b* in the state fixed in the interior of the machine frame 1. This optical system includes a light-projecting device zone provided with a light source 19 and a reflecting wall 20 an original exposure opening 21, and a lens housing 25' having therein a first reflecting mirror 22*a*, a lens 23, a color-separating mechanism 24 such as a light filter, a second reflecting mirror 22*b* and a third reflecting mirror 22*c*, and this optical system is so constructed that the light of the original *a* projected from the light source 19 and reflected on the original *a* is focussed on the transparent plate 15 for light exposure of a copying paper from the original light exposure opening 21 through reflecting mirror 22*a*, lens 23, a filter of the color-separating mechanism 24 and reflecting mirrors 22*b* and 22*c*.

The optical system to be used in the copying machine of this invention includes a light-selecting mechanism for exposing a photosensitive layer of a copying paper to a specific color-separated light and an exposure light quantity-adjusting mechanism for adjusting the exposure light quantity to an optimum quantity with respect to each of a plurality of color-separated lights.

As shown in FIGS. 2-A and 2-B, this light-selecting mechanism includes a color-separating mechanism 24 having a supporting frame 25 disposed to cross an optical path *c* in the optical system and a plurality of color separating filters 26*a*, 26*b* and 26*c* attached to said supporting frame, and a color-separating filter-selecting mechanism 27 for causing displacement of the supporting frame 25 so as to select a color-separating filter to be located on the optical path *c* (see FIGS. 12-A and 12-B). The supporting frame 25 has, for example, a disc-like or cone-like shape and its center is fixed to a shaft 28. A plurality of openings (four openings 29*a*, 29*b*, 29*c* and 29*d* in the drawing) are mounted around this disc or cone. Three primary color filters, namely a blue filter 26*a*, a green filter 26*b* and a red filter 26*c*, are disposed on three of these openings, respectively. The remaining opening 29*d* is kept in the filter-free state for passage of white light. The shaft 28 fixed at the center of the supporting frame 25 is rotatably mounted on the machine frame 1. A pulley 28*a* is fixed to the shaft 28 and it is connected to a dial-type filter-selecting mechanism 27 mounted outside the machine frame through a wire or the like. When the dial of the filter-selecting mechanism 27 is rotated to a prescribed indication point, the shaft 28 is rotated and a desired color filter or the filter-free opening 29*d* is positioned on the optical path *c* (see FIG. 12-A). By virtue of the above structure, it is made possible to freely extract a total light image or monochromatic image of a specific separated color from one original. It is possible to employ, instead of the supporting frame 25 of a rotatable disc or cone shown in FIGS. 2-A and 2-B, a supporting frame shown in FIGS. 3-A and 3-B, on which a plurality of color-separating filters 26*a*, 26*b* and 26*c* and a filter-free opening 29*d* are arranged in a line and which is slidably supported by rails 30 and 30'. A wire 31 is fixed to the central position of each of both the ends of the supporting frame 25 and the wire 31 is connected to the filter-selecting mechanism 27, so that a desired color-separating filter or filter-free opening can be positioned on the optical path *c* by sliding the supporting frame 25 by rotating the dial of the filter-selecting mechanism 27.

In the foregoing embodiments selection of the color-separating filter is accomplished mechanically. In this invention, it is possible to accomplish the selection of the color-departing filter by electric means. For example, in the case of a rotatable supporting frame such as shown in FIG. 2-A, as is illustrated in FIGS. 4-A and 4-B the supporting frame 25 is fitted on a rotary shaft 32 of a motor M, and pins 33*a*, 33*b*, 33*c* and 33*d* corresponding to color-separating filters 26*a*, 26*b* and 26*c* and filter-free opening 29*d*, respectively, are fixed on the surface of the supporting frame 25 at points different from one another in the distance from the rotary shaft 32 and switches S*a*, S*b*, S*c* and S*d* are mounted at such positions that they are pressed by said pins 33*a*, 33*b*, 33*c* and 33*d*, respectively. By virtue of the above structure, it is made possible to stop any of the filters 26*a*, 26*b* and 26*c* and the filter-free opening 29*d* at a position crossing the optical path *c*. More specifically, terminals *a* of switches S*a*', S*b*', S*c*' and S*d*' connected to the filter-selecting mechanism 27 (see FIG. 12-D) are connected to one end of an electric source E, and normally open contacts *b* of the switches S*a*', S*b*', S*c*' and S*d*' are connected to terminals *a* of the switches S*a*, S*b*, S*c* and S*d*, respectively. Further, each of normally closed contacts *c* of the switches S*a*, S*b*, S*c* and S*d* is connected to one terminal of the motor M, and the other terminal of the motor M is connected to the other end of the electric source E.

In the above arrangement, when the dial of the filter-selecting mechanism 27 is turned to a prescribed indication point to press switch S*x*' (*x*' = *a*', *b*', *c*', or *d*'), the normally open contact *b* of said switch S*x*' is closed and the motor M is rotated through the switch S*x* (*x* = *a*, *b*, *c* or *d*) connected to the switch S*x*'. Upon rotation of the motor M, the supporting frame 25 is also rotated, and when the pin 33*x* (*x* = *a*, *b*, *c* or *d*) is contacted with the switch S*x* by rotation of the frame 25, the normally closed contact *c* of the switch S*x* is made open to stop application of an electric current to the motor M, whereby the color-separating filter or filter-free opening corresponding to the pin 33*x* is selectively positioned on the optical path *c*.

Figure 7:
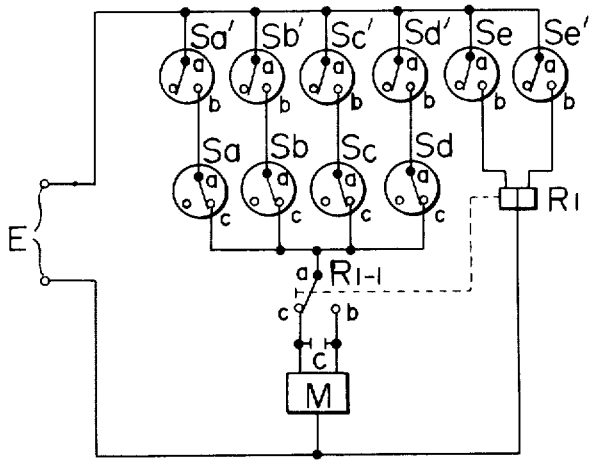
FIG. 7 is an electric circuit diagram or the switch mechanisms of FIG. 6-B.

In the case of a slidable supporting frame 25 such as shown in FIG. 3-A, as shown in FIGS. 6-A and 6-B, pins 34*a* and 34*b* are fixed to both the ends of the supporting frame 25 and switches S*e* and S*e*' are disposed so that they are pressed by the pins 34*a* and 34*b*, respectively, and the rotation direction of the motor M moving the supporting frame 25 reciprocatively is changed over from the normal direction to the reverse direction or vice versa by the above arrangement. More specifically, a wire 31 of the supporting frame 25 is connected to a pulley 36 pivoted on a rotary shaft 32 of a motor M through pulleys 35' rotatably mounted on a plurality of shafts 35, and thus, the motor M is rotated in the normal direction or reverse direction by change-over between the switches S*e* and S*e*' to move the supporting frame 25 in the left or right direction. Pins 33*a*, 33*b*, 33*c* and 33*d* are fixed on the supporting frame 25 at positions differing in the distance from the upper end of the supporting frame 25, and switches S*a*, S*b*, S*c* and S*d* are mounted at such positions that they are pressed by pins 33*a*, 33*b*, 33*c* and 33*d*, respectively. The electric wiring of these members is shown in FIG. 7. Terminals *a* of switches S*a*', S*b*', S*c*' and S*d*' connected to the filter-selecting mechanism 27 (see FIG. 12-D) and of the above switches S*e* and S*e*' are connected to one end of an electric source E, and normally open contacts *b* of the switches S*a*', S*b*', S*c*' and S*d*' are connected to terminals *a* of the switches S*a*, S*b*, S*c* and S*d*, respectively, while normally open contacts *b* of the switches S*e* and S*e*' are connected to one end of a self-retaining relay R1. Further, normally closed contacts *c* of the switches S*a*, S*b*, S*c* and S*d* are connected to a terminal *a* of a contact R1-1 of the relay R1. The contact *c* of the relay contact R1-1 is connected to a terminal of the motor M for the normal direction rotation (clockwise rotation) and the contact *b* of the relay contact R1-1 is connected to a terminal of the motor M for reverse direction rotation (anticlockwise rotation). Both the terminals for the normal direction rotation and for the reverse direction rotation are connected to a starting condenser C of the motor M.

In the above arrangement, when the dial of the filter-selecting mechanism 27 is turned to a prescribed indication point to press the switch S*x*' (*x* = *a*', *b*', *c*' or *d*'), the normally open contact *b* of the switch S*x*' is closed and the motor M is rotated through the switch S*x* (*x* = *a*, *b*, *c* or *d*) connected to said switch S*x*'. At this point, since the switch S*e*' is pressed by the pin 34*b* of the supporting frame 25, the motor M is rotated in the normal direction through the contact *c* of the relay contact R1-1. Although the switch S*e*' is released from pressing by the pin 34*b* when the supporting frame 25 is thus moved in the right direction, the switch S*e*' is self-retained by the relay R1. When the supporting frame 25 continues the movement in the right direction and the pin 33*x* (*x* = *a*, *b*, *c* or *d*) falls in contact with the switch S*x*, the normally closed contact *c* of the switch S*x* is opened to stop application of an electric current to the motor M, with the result that the rotation of the motor M is stopped and the color-separating filter or filter-free opening corresponding to the pin 33*x* is selectively positioned on the optical path *c*. When the dial of the filter-selecting mechanism 27 is turned to another indication point, the above operation is similarly repeated, and when the supporting frame 25 completes the movement in the right direction, the switch S*e* is pressed by the pin 34*a*, whereby the contact *c* of the relay contact R1-1 is opened and the contact *b* is closed and the motor M is rotated in the reverse direction to move the supporting frame 25 into the left idrection, with the result that the switch S*x* falls in contact with the pin 33*x* and a newly selected color-separating filter or filter-free opening is selectively positioned on the optical path *c*.

Figure 8:
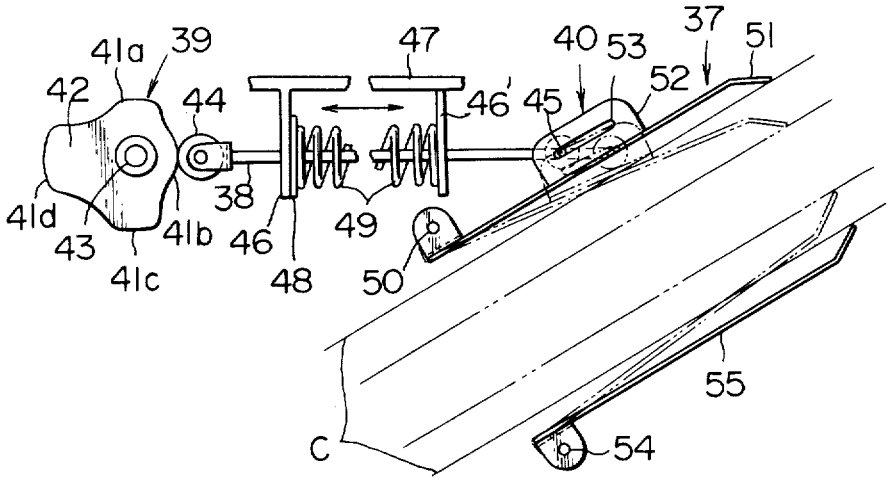
FIG. 8 is a view illustrating the function of an instance of the exposure light quantity-adjusting mechanism.

The exposure light quantity-adjusting mechanism to be used in this invention may be any of a mechanical mechanism, an electric mechanism and a combination of mechanical and electric mechanism, as far as it can select an optimum exposure light quantity depending on the image of a selected light. An instance of such exposure light-adjusting mechanism is shown in FIG. 8. The mechanism shown in FIG. 8 comprises variable iris mechanism 37 disposed to cross the optical path *c* in the optical system, a cam follower 38, a cam mechanism 39 interlocked with the color-separating filter-selecting mechanism 27 to maintain the cam follower 38 at a prescribed position in correspondence with the selected color-separating filter, and a coupling mechanism 40 for changing the degree of opening in the iris mechanism 37 in correspondence with the displacement of the cam follower 38.

The cam mechanism 39 comprises, for example, a cam board 42 including 4 cams, namely a cam 41*a* corresponding to a blue filter, a cam 41*b* corresponding to a green filter, a cam 41*c* corresponding to a red filter and a cam 41*d* corresponding to a filter-free opening.

The cam board 42 is fixed to a shaft 43 of the dial of the filter-selecting mechanism 27 so that when a desired color-separating filter or filter-free opening is selected by the filter-selecting mechanism 27, the corresponding cam is caused to fall in contact with the cam follower 38.

The cam follower 38 has a driven pulley 44 rotatably mounted at one end thereof and a pin 45 disposed at the other end, and is supported by a supporting member 47 fixed to the machine frame and having supporting arms 46 and 46'. A plate 48 fitted on the cam follower 38 is disposed between the supporting arms 46 and 46', and a coil spring 49 is mounted between said plate 48 and the supporting arm 46', so that the driven pulley 44 is always allowed to have a pressing contact with the peripheral surface of the cam board 42 by an elastic force of the coil spring 49. The above pin 45 is fitted into a long hole 53 of a projection 52 formed on the back face of a shutter plare 51 of the variable iris mechanism 37 pivoted on the shaft 50.

In the above arrangement, by turning of the dial of the filter-selecting mechanism 27, the shaft 43 is rotated so as to select a desired color-separating filter, and when with rotation of the cam board 42 the cam follower 38 is moved in the direction indicated by an arrow, the above pin 45 moves in the long hole 53 to rotate the shutter plate 51 and shift its position between a point indicated by the solid line and a point indicated by the dotted line. In this manner, the exposure light quantity is adjusted to an optimum quantity depending on the percent transmission of the selected color-separating filter.

In order to effect fine adjustment of the exposure light quantity determined by the shutter plate 51 depending on the image tone, a shutter plate 55 fitted on a shaft 54 is provided separately from the above shutter plate 51, and the shaft 54 is rotated by optional means so that the shutter plate 55 is turned between a point indicated by the solid line and a point indicated by the dotted line.

Figure 9:
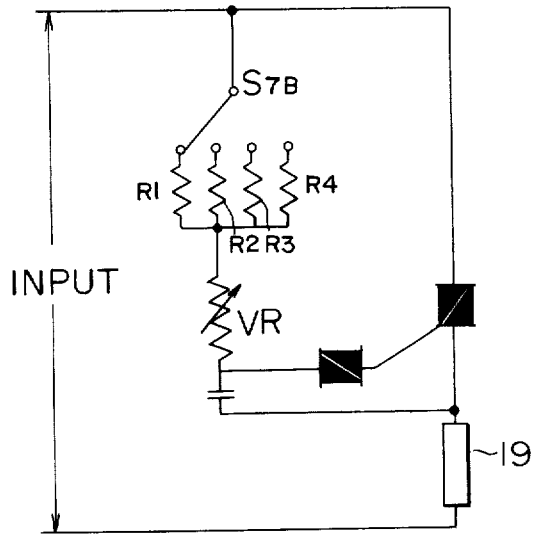
FIG. 9 is an electric circuit diagram for the exposure light quantity-adjusting mechanisms in which the light quantity adjustment is performed electrically.

In the foregoing embodiment, the adjustment for attaining an optimum exposure light quantity depending on the selected color-separating filter is accomplished by mechanical means. In this invention, this adjustment can also be accomplished by electric means. For example an exposure light source 19 is connected to an electric source through an exposure light quantity-adjusting circuit such as shown in FIG. 9. This exposure light quantity adjusting circuit consists a phase-controlling circuit interlocked with the above color-separating filter-selecting mechanism to control gate signals. In FIG. 9, a group of fixed resistances R1, R2, R3 and R4 are connected to a variable resistance VR in series to form a circuit for a lamp 19. One ends of the fixed resistances are designed to be connected to corresponding contacts of a change-over switch S7B, respectively, and the other ends of the fixed resistances are connected to the variable resistance VR. The number of contacts of the change-over switch S7B corresponds with the number of the sum of the color-separating filters and filter-free opening (the switch S7B has 4 contacts in FIG. 4), and the resistivity values of these fixed resistances are so determined that an optimum illuminating power can be obtained in correspondence with the presence or absence of a filter, the quantity of transmitted light or the spectral sensitivity of the photosensitive layer of copying paper.

In the foregoing embodiment of this invention, when a desired filter or filter-free opening is selected by the color-separating filter-selecting mechanism 27, the switch S7B is interlocked with the selecting mechanism 27 to effect change-over among fixed resistances, and the phase control of an input of the lamp is performed by change of gate signals by this change-over of the fixed resistances. Thus, when an illuminating power of the lamp is adjusted to a desired level depending on an original to be copied by the variable resistance VR, an optimum illuminating power can always be obtained regardless of the kind of a light image.

One of important features of this invention is that a development operation-selecting mechanism for selecting an optional development operation among a plurality of development operations differing in the toner hue is provided in association with the abovementioned light-selecting mechanism and exposure light quantity-adjusting mechanism, and said light-selecting mechanism and development operation-selecting mechanism are actuated independently or in the state interlocked with each other so that a copy having a desired coloring effect can be obtained.

Returning to FIG. 1, the developing device zone indicated as a whole by referential numeral 6 includes a plurality of development passages 56*a*, 56*b*, 56*c* and 56*d* independent from one another and development passage-selecting mechanisms 57*a*, 57*b* and 57*c* for selecting an optional development passage among these passages 56*a*, 56*b*, 56*c* and 56*d* and guiding a copying paper carrying an electrostatic latent image formed thereon to said selected development passage.

These development passages 56*a*, 56*b*, 56*c* and 56*d* are arranged so that they overlap one another in the horizontal direction, and a passage for transfer of an exposed copying paper is disposed vertically to the development passages. This transfer passage comprises a pair of driving rollers 12*c* and 12*c'*, 12*d* and 12*d'*, 12*e* and 12*e'*, and 12*f* and 12*f'* corresponding to the development passages 56*a*, 56*b*, 56*c* and 56*d*, respectively, and confronting guide plates 58*d* and 58*d'*, 58*e* and 58*e'*, and 58*f* and 58*f'* disposed between every two adjacent pairs of the driving rollers.

Each of the development passages 56*a*, 56*b*, 56*c* and 56*d* had a concave curved shape, and it is disposed so that an upward extension line of the passage on the introduction side is substantially in agreement with the discharge side position of the corresponding pair of the driving rollers.

Figure 10:
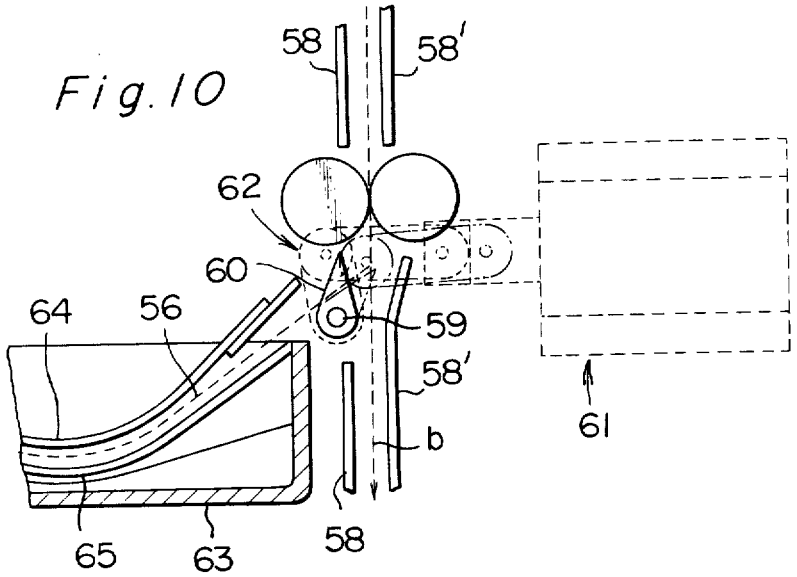
FIG. 10 is an enlarged sectional view showing a development passage-selecting mechanism.

Each of development passage-selecting mechanisms 57 (hereinafter alphabetical suffixes are omitted except the case where a specific member is expecially mentioned among common members indicated by the same numerical reference) has, as shown enlargedly in FIG. 10, a guide member or deflector 60 oscillatably mounted on the machine frame by a pin 59, a solenoid mechanism 61 and a link mechanism 62 which connects the guide member or deflector 60 to the solenoid mechanism 61 and is actuated by the solenoid mechanism 61 to oscillate the guide number or deflector 60 to the point indicated by the dotted line. The guide member or deflector 60 is disposed below a pair of the driving rollers of the development passage 56 and on the transfer passage on the side where the development passage 56 is positioned. When the corresponding solenoid mechanism 61 is not actuated, the guide member or deflector 60 is located at the position indicated by the solid line so that it does not cross the copying paper transfer passage extending in the vertical direction but crosses the extension line of the development passage. When the solenoid mechanism 61 is actuated, the guide member or deflector 60 is turned to the position indicated by the dotted line so that it crosses the copying paper transfer passage *b* extending in the vertical direction and it connects the extension line of the development passage to the pair of the driving rollers. In the above arrangement, when the solenoid 61*a* of the development passage-selecting mechanism 57*a* is actuated, the guide member or deflector 60*a* is oscillated to cross the copying paper transfer passage extending in the vertical direction, and it guides a copying paper discharged downwardly by a pair of driving rollers 12*c* and 12*c'* toward the development passage 56*a*. In the same manner, the copying paper is guided to the development passage 56*b* or 56*c* by actuation of the corresponding development passage-selecting mechanism 57*b* or 57*c*. When none of the development passage-selecting mechanisms 57*a*, 57*b* and 57*c* are actuated, the copying paper is guided to the lowermost development passage 56*d*.

When a combination of a photosensitive paper transfer passage extending in the vertical direction, a plurality of development passages disposed in the multistaged manner so that they overlap one another in the horizontal direction, and guide members or deflectors disposed at junctions of the development passages with the transfer passage, such as shown in FIG. 1, is employed, the mechanical structure of the developing device zone can be greatly simplified and the frequency of occurrence of paper jamming in the transfer passage can be drastically reduced. Further, when a plurality of development passages for performing development by employing specific toners are disposed independently from one another and any one of these development passages is selected and a copying paper is guided to this selected development passage, copies free of color mingling or stains can be obtained.

Each development passage 56 is disposed above a case 63 between an upper saucer member 64 and a lower saucer member 65, and it is so arranged that a copying paper to be developed is passed through this development passage. A liquid developer drawing mechanism including a motor 66, a draw-up pump 67 and a conduit 68 is disposed to feed a liquid developer to the development passage. By this mechanism, the liquid developer is drawn up onto the upper saucer member 64, flown into the development passage 56 and falls in contact with a copying paper having an electrostatic latent image to develop the latent image. On the discharge side of the development passage 56 are disposed a pair of squeeze rollers 69 and 69' to squeeze out the excessive liquid developer applied to the copying paper and discharge the copying paper from the development passage.

The development passage 56 can be formed integrally with the liquid developer-drawing mechanism, or both the members may be disposed separately. For example, as shown in FIG. 1, development passages 56*a*, 56*b* and 56*c* for applying yellow, red (magenta) and blue (cyane), toners, respectively, are disposed separately from liquid developer tanks 63*a'*, 63*b'* and 63*c'*, and liquid developers drawn up into the development passages through conduits 68*a*, 68*b* and 68*c* are recycled to respective tanks through return conduits 68*a'*, 68*b'* and 68*c'*. In the unit of the development passage 56*d* for applying a black toner, the case 63*d* has a function as a tank, and a pump and a motor are mounted integrally therewith.

In this invention, no particular limitation is imposed on the order in which developing toners differing in the hue are contained in a plurality of development passages which are disposed to overlap one another in the horizontal direction. For example, instead of the above-mentioned feature where yellow, red, blue and black toners are contained in this order from the above, there can be adopted a feature where the uppermost development passage 56*a* is used as the development passage for application of a black toner. Since black-and-white reproduction is conducted most frequently in many cases, by adoption of the above structure, the time required for copying can be shortened.

In this invention, in order to check the occurrence of paper jamming on the copying paper passage and facilitate the removal of jammed papers, it is preferred that the entire length of the copying paper transfer passage can be freely opened and each development passage can be freely withdrawn from the interior of the machine frame. For attaining this preferred feature, one rollers 12*a'*, 12*b'*, 12*c'*, 12*e'* and 12*f'* of pairs of rollers disposed on one side of the copying paper transfer passage *b* extending vertically, one shield case 13' of the charging mechanism, and one guide plates 15', 58*d'*, 58*e'* and 58*f'* of pairs of confronting guide plates are attached to a frame member 71 which is mounted on the machine frame 1 by a hinge 70 so that it can be freely opened or closed. Further, one roller 69 of each pair of squeeze rollers is mounted integrally with the supporting case 63 of the corresponding development passage, and the supporting case 63 of this development passage is dismountably attached to the machine frame. In the above arrangement, when the frame member 71 is opened, the operation of checking occurrence of paper jamming in the vertical transfer passage or removing a jammed paper from the inside of the machine can be greatly facilitated. Further, when the development passage 56 is drawn out to the side direction of the machine together with the supporting case 63, the operation of checking occurrence of paper jamming in the development passage 56 where paper jamming occurs most frequently or removing a jammed paper from the inside can be performed with ease.

In this invention, in association with the above-mentioned feature where a plurality of development passages differing in the kind of the toner to be used for the development are disposed independently from one another and a copying paper is guided to one of these development passages that is especially selected, it is preferred that upon actuation of the development passage-selecting mechanism 57*x* ($x = a, b, c$ or $d$), only the liquid developer-drawing mechanism 67*x* of the selected development passage 56*x* is selectively actuated. If such structure is adopted, it is possible to prevent unnecessary degradation in liquid developers and attain such advantages as saving of electric power and reduction of noises.

A copying paper transfer system including a group of driving rollers and a belt is disposed to guide the developed copying paper discharged from a pair of squeeze rollers 69 and 69' to the drying or fixing device zone. In this invention, it is preferred that one drying or fixing device zone is disposed and any of copying papers discharged from development passages 56 is discharged from one discharge outlet through said one drying or fixing device zone.

For attaining this preferred feature, as shown in FIG. 1, one or more transfer belts 72, one face 72*a* of which extends to cross vertically a discharge side extension line of the development passage 56*x* or come in contact with said discharge side extension line and the other face 72*b* of which extends to pass through the fixing device zone, are disposed in the state supported by a group of pulleys 73. Pairs of driving rollers 74 and 74' for transferring copying papers, which correspond to respective development passages, are disposed at points present on discharge side extension lines of respective development passages 56*x* and adjacent to said transfer belt 72. In the above arrangement, a copying paper discharged from the pair of squeeze rollers 69 and 69' is nipped between the driving rollers 74 and 74' and delivered to the transfer belt 72 by the rollers 74 and 74', and then it is forwarded to the drying or fixing device zone 7 in the state carried on the transfer belt 72.

The drying or fixing zone 7 is disposed on the upper face 72*b* of the transfer belt and includes a fan 75 for sucking heat from the light source 19 and an air duct 76, one end of which is connected to the air discharge opening of the fan 75 and the other end of which is opened toward the transfer belt face 72*b*. In this arrangement, the heat from the light source is blown onto the face 72*b* of the transfer belt to effect the drying or fixing operation. In the interior of the air duct 76, a heater H can be disposed to provide heat necessary for drying of a copying paper in addition to hot air discharged from the lens housing 25'. After the drying or fixing operation has thus been completed, a copy is discharged from the inside of the machine.

Figure 11:
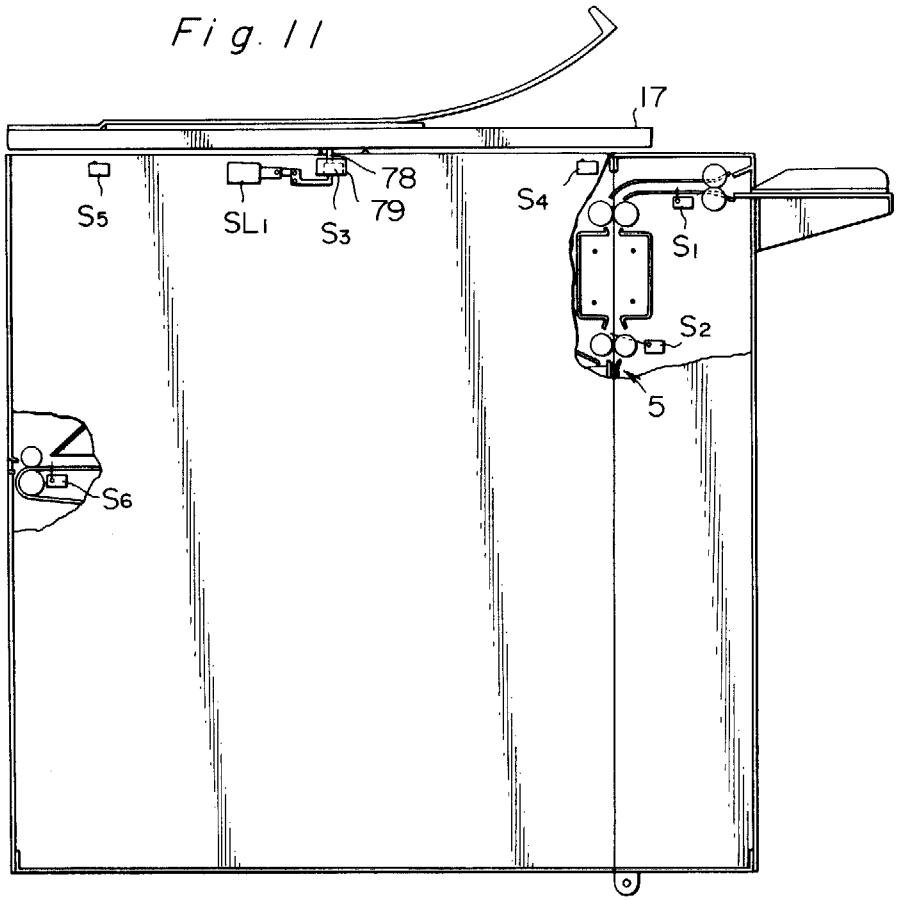
FIG. 11 is a view illustrating arrangement of a switch mechanism for effecting synchronous movement of a moving frame and a photosensitive paper and controlling each copying step.

In the electrostatic copying machine shown in FIG. 1, the synchronous movement of the original-moving frame and copying paper and the control of each copying step are performed by a switch mechanism such as shown in FIG. 11 and an electric system shown in the electric circuit diagram of FIG. 13.

In the arrangement shown in FIG. 11, switch S1 is a switch for detecting the forward end of a copying paper 2 fed and starting the right direction movement (movement of the step for preparing for light exposure) of the moving frame 17, and switch S4 is a switch for detecting arrival of the moving frame 17 at the most right position and stopping the moving frame 17 at this position (position for starting light exposure). Switch S2 is a switch for detecting approach of a charged copying paper to the copying paper-exposing zone 5 and starting the left direction movement (movement of the light expopsure step) of the moving frame 17. Switch S5 is a switch for detecting arrival of the moving frame 17 at the most left position (position of completion of the light exposure step) and starting the right direction movement (return movement) of the moving frame 17. Further, switch S3 is a switch for detecting return of the moving frame 17 to the standard original position and stopping the moving frame 17 at this position.

Stopping of the moving frame 17 at the standard original position is performed by engaging a projecting rod 78 mounted on the moving frame 17 with a corresponding stopper 79, as shown in FIG. 11. The stopper 79 is engaged with the rod 78 when a start solenoid SL1 is not actuated, and when the start solenoid SL1 is actuated, the stopper 79 is released from the engagement. Accordingly, the start solenoid SL1 is actuated when the moving frame 17 starts the movement of the step for preparing for light exposure, and actuation of the start solenoid SL1 is stopped when the moving frame 17 starts the return movement. Change-over of the moving direction of the moving frame 17 is performed by change-over between a clutch C1 for the right right direction movement and a clutch C2 for the left direction movement in a moving frame-driving system (not shown).

Switch S6 disposed on the discharge side of the copying paper transfer passage detects discharge of a copying paper from the inside of the machine and permits feeding of another copying paper.

In this invention, the light-selecting mechanism and the developing operation-selecting mechanism are actuated either independently or in the state interlocked with each other. In association with this feature, a dial 80 of the color-separating filter-selecting mechanism and exposure light quantity-adjusting mechanism and a dial 81 of the development passage-selecting mechanism are disposed so that they can be turned independently or in the state interlocked with each other, as shown in FIGS. 12-A, 12-B, 12-C and 12-D.

More specifically, in FIG. 12-A, the dial 80 has projections 82*a* and 82*b*, and it is fitted on the outside of a cover 84 at the end of a shaft 43 having the above-mentioned cam board 42 attached thereto and being mounted rotatably on an inner machine frame 83, so that the dial 80 can be turned outside the machine. A pulley 85 is fitted on the shaft 43 and connected by a wire 86 to a pulley 28*a* fitted on the other end of the shaft 28 of the supporting frame 25 (not shown) having color-separating filters and filter-free opening, through pulleys 88*a*, 88*b*, 88*c* and 88*d* rotatably attached to shafts 87*a*, 87*b*, 87*c* and 87*d*.

The dial 81 of the development passage-selecting mechanism has a concave shape and includes on the side thereof recesses 89*a* and 89*b* with which projections 82*a* and 82*b* of the dial 80 are engaged. The dial 81 is fitted on a shaft 90 provided coaxially with said shaft 43 but capable of rotating independently from the shaft 43, or the dial 81 is provided integrally with said shaft 90. A shaft 91 independent from the shaft 90 is disposed at a position having a contact with the top end of the shaft 90 so that the shaft 91, like the shaft 90, can rotate coaxially with said shaft 43 and independently from the shaft 43. A slip member 92 is disposed between the dial 81 and the cover 84 (machine frame 1) to facilitate turning of the dial 81. A delivery member having a plurality of holes 93, such as a disc 94, is fitted on the top end portion of the shaft 90, and a coil spring 95 is disposed between the disc 94 and cover 84, so that the dial 81 is always kept in the state contacted with the slip member 92 by an elastic power of the coil spring 95. A member to be delivered which has a plurality of pins 96, for example, a disc 97, and a delivery member, for example, a gear 98, are fitted on the shaft 91. Pins 96 of the disc 97 are inserted into holes 93 of the disc 94, so that the rotation of the disc 94 is delivered to the disc 97 while the pins 96 are not taken out of holes 93 even when the disc 94 moves right and left. The shaft 91 is rotatably supported by a supporting plate 100 fixed to the inner machine frame 83 by a plurality of shafts 99, and a stop ring 101 is disposed to prevent the shaft 91 from moving right and left. A change-over switch S7A is fixed to the supporting plate 100 to effect change-over among development passage-selecting mechanisms 57*x*, and gear 102 fitted on the rotary shaft of the switch S7A is engaged with the above-mentioned gear 98.

As shown in FIGS. 12-B and 12-C, marks or letters 103, 104, 105 and 106 indicating colors to developed, namely, yellow, red, blue and black, are formed on the cover 84 around the dial 81 or on a panel plate provided separately around the dial 81, and indicating marks 107 and 108 are formed on the surface of the engagement point 89*a* of the dial 81 and on the surface of the projection 82*a* of the dial 80, respectively.

In the above arrangement, if monochromatic copies are desired, when the indicating mark 107 is set at one of marks or letters 103 to 106, which corresponds to the color to be reproduced, the rotation of the dial 81 is coveyed to the gear 98 through shaft 90, disc 94, pin 96, disc 97 and shaft 91 to rotate the gear 102 engaged with the gear 98 and cause the switch S7A to select the development passage for the color corresponding to said mark or letter. Then, the indicating mark 108 of the dial 80 is set at said selected mark or letter among those 103 to 106 independently from the dial 81. With rotation of the dial 80, the pulley 85 fitted on the shaft 43 is rotated, and in turn, the pulley 28*a* is rotated through the wire 86, whereby a specific color-separating filter or filter-free opening of the supporting frame 25 is selected in correspondence with said mark or letter and simultaneously the cam board 42 fitted on the shaft 43 is rotated to select an optimum exposure light quantity in correspondence with the so selected color-separating filter or filter-free opening. Thus, preparation for light exposure and development for obtaining monochromatic copies of the desired color has been completed.

In case multi-colored copies are desired, the dial 81 is pulled out against the elastic power of the coil spring 95, and projections 82*a* and 82*b* are inserted into recesses 89*a* and 89*b* of the dial 81 (see FIG. 12-C). Thus, the dials 80 and 81 can be turned synchronously. When the indicating mark 107 of the dial 81 is set at one of indicating marks 103 to 106, selection of a color-separating filter or filter-free opening, adjustment of an optimum exposure light quantity and selection of a development passage can be accomplished at a stroke. In the foregoing manner, the indicating mark 107 is set at marks 103 to 106 in order and the copying step is repeated, whereby a multi-colored copy corresponding to the colored original can be obtained.

When selection of the filter and adjustment of the exposure light quantity are performed electrically in accordance with embodiments shown in FIGS. 4-B, 5, 6-B and 9, for example, a rotary arm 110 having a convexity 109 at the top end thereof is fitted on the shaft 43 instead of the above-mentioned cam board 42. Said convexity 109 is disposed at such a position that it can press switches S*a*′, S*b*′, S*c*′ and S*d*′. Further, a gear 111 is fitted on the shaft 43 so that it is engaged with the change-over switch S7B for selecting an optimum exposure light amount. The switches S7B, S*a*′, S*b*′, S*c*′ and S*d*′ are retained by a supporting plate 114 fixed to the inner machine frame 83 by means of a plurality of shafts 113.

Selection of the development passage is conducted by rotation of the dial 81 in the same manner as in FIG. 12-A. When the dial 80 is then turned, one of switches S*x*′ ($x' = a', b', c'$ and $d'$) is selectively pressed to effect selection of the color-separating filter or filter-free opening, and simultaneously, an optimum exposure light auantity is selected by the switch S7B through the gear 111 fitted on the shaft 43 and the gear 112 engaged therewith. The copying operation for obtaining multi-colored copies will be apparent from the description made with reference to FIG. 12-A. Therefore, further illustration of this copying operation is omitted.

As mentioned above, the dial 80 is mechanically connected to the shaft 28 of the supporting frame 25 of the color-separating mechanism 24, or when the color-separating mechanism 24 is electrically actuated, the dial 80 is connected to the rotary arm 100 pressing selectively one of switches S*x*′ ($x' = a', b', c'$ and $d'$). Further when adjustment of the exposure light quantity is performed mechanically (FIG. 8), the dial 80 is mechanically connected to the shaft 43, or when the adjustment of the exposure light quantity is conducted electrically, the dial 80 is connected to the gate signal change-over switch S7B (FIG. 9) of the lamp circuit. On the other hand, the dial 81 is connected to the change-over switch S7A for change-over and actuation of solenoids 61*a* (SL2), 61*b* (SL3) and 61*c* (SL4) of the development passage-selecting mechanism. The change-over switch S7A simultaneously effects the change-over of pump motors 66*a* (PM1), 66*b* (PM2), 66*c* (PM3) and 66*d* (PM4).

Operations of the electrostatic copying machine shown in FIG. 1 are performed by the electric circuit shown in FIG. 13 in the following manner:

I. BLACK-AND WHITE REPRODUCTION

1. An input switch MS is contacted to actuate a fan motor FM and a driving motor DM, and a paper feeding-indicating lamp L is lighted.

2. The dial 80 is set at the mark indicating the filter-free opening and the dial 81 is set at the mark indicating the black toner, or the dial 80 is connected to the dial 81 and the assembly is set at the mark indicating black-and white reproduction, whereby the color-separating mechanism 24 is set at the filter-free opening 29*d*, the exposure light quantity circuit is connected to the contact *d* for the filter-free opening by the switch S7B, and the development passage-selecting circuit is connected to the contact *d* for black development by the switch S7A, whereby operations of light selection, exposure light quantity adjustment and selection of the development passage are accomplished. Motor 66*d*

(PM4) for a motor of the black toner development passage 56*d* is actuated.

3. Fine adjustment of the exposure light quantity is accomplished by the variable resistance VR (contrast adjustment).

4. A copying paper is manually fed from a copying paper-feeding opening 3 (paper feeding), whereby the normally open switch S1 is closed and the following operations are performed.

4-1. The start solenoid SL1 is actuated through switches S3*b* and S1 (the moving frame 17 is unlocked).

4-2. Simultaneously, the relay R1 is actuated and the relay contact R1-1 is closed to establish a self-retaining circuit of the relay R1.

4-3. The relay contact R1-2 is closed, and the clutch C1 for moving the moving frame in the right direction is actuated after on-delay through the switch S4*b* and the relay contact R2-1*b* (the preparation step of the moving frame 17 is started).

4-4. The relay contact R1-3 is closed to actuate a high voltage electric source HVU of the charging device zone, whereby charging of the copying paper passing through the transfer passage by corona discharge is started.

4-5. The relay contact R1-4 is opened and the paper feeding-indicating lamp L is put out.

5. By the movement of the moving frame 17, the contact *b* of the switch S3 is opened and the contact *a* is closed, but the movement continues because of the self-retention by the relay contact R1-1.

6. The moving frame 17 arrives at the right end of its passage to actuate the switch S4, whereby the contact *b* of the switch S4 is opened and the contact *a* is closed, and the following operations are accomplished.

6-1. The normally closed contact *b* of the switch S4 is opened to stop the actuation of the clutch C1 for moving the moving frame 17 in the right direction (the moving frame 17 is stopped at the right end of the passage).

6-2. The relay R2 is actuated through the normally open contact *a* of the switch S4. the relay contact R2-2 is closed to establish the self-retaing circuit of the relay R2.

6-3. The normally closed contact *b* of the relay contact R2-1 is opened and the normally open contact *a* is closed (preparation for the left direction movement of the moving frame).

6-4. The relay contact R2-3 is closed to light an exposure light source at an optimum illuminating power.

7. The forward end of the charged copying paper presses the switch S2 to actuate it, and the relays R3A and relay R3B are actuated through the switch S2, whereby the following operations are performed.

7-1. The relay contact R3B-1 is closed to self-retain relays R3A and R3B.

7-2. The relay contact R3B-2 is opened to keep the paper feeding-indicating lamp L unlighted.

7-3. The relay contact R3A-1 is closed, and the clutch C2 for moving the moving frame in the left direction is actuated through relay contacts R3A-1 and R2-1*a*.

Thus, the moving frame 17 starts the movement for the light exposure step, and the total light images of the original are projected on the photosensitive layer of the copying paper passing through the copying paper light exposure zone (light exposure step).

7-4. In each development passage-selecting mechanism, relay contacts R3A-2, R3A-3 and R3A-4 inserted in series in circuits of solenoids 61*a* (SL2), 61*b* (SL3) and 61*c* (SL3), respectively, are closed, but since each of the contacts *a*, *b* and *c* of the development passage changeover switch is opened, these solenoids are not actuated.

8. While the moving frame performs the movement for the light exposure step, it presses the switch S3 to open the contact S3*a*, but since the relay contact R1-2 is closed, the circuit of the contact S3*a* is self-retained and kept actuated.

9. The copying paper travels and the rear end passes through the point of the switch S2 to open the switch S2, but the relays R3A and R3B are kept actuated because of self-retaining circuit of the relay contact S3B-1.

10. Since none of solenoids SL2, SL3 and SL4 for actuation of the development passage-selecting mechanism are actuated, the copying paper is guided into the lower-most development passage 56*d* and is developed with the black toner.

11. When the moving frame reaches the left end of its passage, it presses the switch S5 to open the switch S5, whereby the following operations are performed.

11-1. The start solenoid SL1 is de-energized, and the stopper 79 returns to the engagement point (preparation of locking of the moving frame).

11-2. The actuation of the relay R1 is stopped, and simultaneously, the relay contacts R1-1 and R1-2 are opened and the relay contact R1-4 is closed.

11-3. The relay contact R1-3 is opened, and the actuation of the high voltage electric source HVU of the charging mechanism is stopped.

11-4. The actuation of the relay R2 is stopped to open the relay contact R2-2.

11-5. The relay contact R2-3 is opened to put out the exposure light source 19.

11-6. The normally open contact *a* of the relay contact R2-1 is opened to stop the operation of the clutch C2 for moving the moving frame in the left direction and close again the normally closed contact *b* of the relay contact R2-1.

The clutch C1 for moving the frame in the right direction is actuated through the normally closed contact *a* of the switch S3, the normally closed contact *b* of the switch S4 and the relay contact R2-1*b* (start of return travel of the moving frame).

12. The moving frame 17 travels in the right direction and returns to the standard original position to press the switch S3 and open the normally closed contact *a* of the switch S3, whereby the actuation of the clutch C1 for moving the moving frame in the right direction is stopped. Further, the projecting rod 78 of the moving frame 17 is engagement with the recess of the stopper 79 to lock the moving frame.

13. The copying paper presses the switch S6 disposed in the vicinity of the discharge opening of the copying paper transfer passage. Thus, the switch S6 is opened to stop the actuation of the relays R3A and R3B and open the relay contacts R3A-1, R3A-2, R3A-3, R3A-4 and R3B-1.

The relay contact R3B-2 is closed and the paper feeding-indicating lamp L is lighted through the relay contacts R3B-2 and R1-4 to indicate that next copying is now possible.

II. MONOCHROMATIC REPRODUCTION USING YELLOW, RED OR BLUE TONER

In case copies having all the image areas colored into yellow, red or blue are prepared from a sheet of an original, the copying operation is conducted according to the same procedures as adopted in the above case I except that the following changes are made.

2'. The dial 80 is turned to the "filter-free" mark, and the dial $8_1$ is set to the mark indicating yellow, red or blue reproduction.

The color-separating mechanism and exposure light quentity-adjusting mechanism circuits have the same structures as described in (I-2) above. The development passage-selecting mechanism circuit is set to any of yellow development contact *a*, red development *b* and blue development contact *c* by the switch S7A, and a motor selected among development passage pump motors PM1, PM2 and PM3 is actuated.

7'. In the monochromatic reproduction, the following operations (7-4') are conducted instead of (7-4) mentioned above. Other operations are the same as described in (I-7) above.

7-4'. Relay contacts R3A-2, R3A-3 and R3A-4 inserted in series into circuits of solenoids SL2, SL3 and SL4 of development passage-selecting mechanisms 57, respectively, are closed. A solenoid connected to the contact selected among contacts *a*, *b* and *c* of the switch S7A is actuated to oscillate the corresponding guide nail 57*a*, 57*b* or 57*c* so as to connect the corresponding development passage 56*a*, 56*b* or 56*c* to the copying paper transfer passage.

10'. The copying paper is guided to the development passage 56*a*, 56*b* or 56*c* by the guide nail 57*a*, 57*b* or 57*c* and is developed with a yellow, red or blue toner.

III. REPRODUCTION WHERE LIGHT IMAGES OF SINGLE COLORS ARE EXTRACTED AND MONOCHROMATIC OR MULTI-COLORED COPIES ARE OBTAINED BY USING TONERS OF CORRESPONDING HUES

According to this invention, it is possible to extract a specific color-separated light image from an original and effect development with use of a toner of a hue corresponding to the light image.

In this case, the copying operation is conducted according to the same procedures as adopted in the above case I except that the following changes are made.

2''. The dial 80 is connected (interlocked) with the dial 81, and the dial assembly is set to a disered indication mark selected among marks indicating red-color reproduction, blue-color reproduction and yellow-color reproduction.

Thus, in the color-separating mechanism, a desired filter is selected among blue filter 26*a*, green filter 26*b* and red filter 26*c*, and simultaneously, the exposure light quentity-adjusting circuit is connected to the contact *a*, *b* or *c* corresponding to the selected filter by the change-over switch S7B and the development passage-selecting passage is connected to the yellow, red or blue development contact *a*, *b* or *c* corresponding to the selected filter by the change-over switch S7A.

One motor corresponding to the selected filter is selected among development passage pump motors PM1, PM2 and PM3 and is selectively actuated.

7''. In this case, the same operations as described in (I-7) above are conducted except that the following operations (7-4'') are performed instead of the above-mentioned operations (7-4).

7-4''. Each of relay contacts R3A-2, R3A-3 and R3A-4 inserted in series into circuits of solenoids SL2, SL3 and SL4 of the development passage-selecting mechanism, respectively, is closed.

The solenoid connected to the contact selected among the contacts *a*, *b* and *c* of the switch S7A is actuated to oscillate the corresponding guide nail 57*a*, 57*b* or 57*c* so as to connect the corresponding development passage 56*a*, 56*b* or 56*c* to the copying paper transfer passage.

More specifically, in case the selected filter is the blue filter 26*a*, the yellow toner development passage 56*a* is connected to the copying paper transfer passage, and when the selected filter is the green filter 26*b*, the red toner development passage is connected to the copying paper transfer passage. Further, when the selected filter is the red filter 26*c*, the blue toner development passage 56*c* is connected to the copying paper transfer passage.

10''. The copying paper is guided to the development passage 56*a*, 56*b* or 56*c* corresponding to the selected filter by the guide nail 57*a*, 57*b* or 57*c*, and development is effected with a toner of the same color as the filter-permeating light.

According to this embodiment of this invention, it is possible to obtain a monochromatic copy having an image corresponding to the color-separated light image and having the same hue as that of said light image.

In case a multi-colored copy having the same color images as those of an original is obtained, namely in case a color copy is obtained, with respect to one original and one copy, yellow color reproduction, red color reproduction and blue color reproduction optionally with black-and-white reproduction are performed, respectively, in this order according to the above procedures.

IV. REPRODUCTION WHERE SINGLE COLOR LIGHT IMAGE IS EXTRACTED AND DEVELOPMENT IS CONDUCTED WITH USE OF TONER HAVING HUE DIFFERENT FROM THAT OF EXTRACTED LIGHT IMAGE

In this case, the dial 80 is set at the mark indicating yellow color reproduction (blue filter), red color reproduction (green filter) or blue color reproduction (red filter), and the dial 81 is set at the mark different from the mark at which the dial 80 is set, which is selected among marks indicating red color reproduction, yellow color reproduction, blue color reproduction and black color reproduction. Other operation procedures are the same as described above in respect to cases I and II.

If the copying operation is performed with respect to the filter and toner of the color different from the color of the filter and toner selected in the preceding copying operation, there can be obtained a multi-colored copy having an image of an optional combination of colors.

When the copying machine of this invention is employed, any of the foregoing copying operations can be adopted depending on the desired kind of a copy. For example, not only ordinary black-and-white and monochromatic copies and ordinary multi-colored copies, but also artificial monochromatic and multi-colored copies of desired optional colors differing from colors of originals can be obtained conveniently. Copies of the latter type are very useful when various plans and drawings are prepared in designing, planning or the like.

In this invention, by virtue of the feature that a plurality of development passage are independently disposed and a plurality of a pressing board 18 for pressing the original *a* to the transparent plate 16 are disposed above the machine frame 1.

A movable light exposure device 116 is disposed between said copying paper supporting stand 115 and transparent plate 16 to connect optically the transparent plate 16 with the copying paper supporting stand and focus an image of the original *a* on a copying paper 2 placed on the stand 115. This movable light exposure device 116 comprises a projector device zone including a light source 19 and a reflection wall 20, an opening 21*a* for light exposure of an original, a series of reflection mirros 22*a*, 22*b* and 22*c*, a lens 23, a color-separating mechanism 24 such as a light filter, and a housing 117 holding a charging device 4 before an opening 21*b* for light exposure of a copying paper. The movable light exposure device 116 is supported so that it can be moved reciprocatively in the horizontal direction, and it is driven by a drive mechanism capable of driving in both the positive and reverse directions. Thus, by the horizontal reciprocative movement of the light exposure device 116 between the copying paper-supporting stand 115 and a transparent plate 16, imagewise charging on the copying paper 2 and imagewise light exposure are accomplished.

The copying paper-supporting stand 115 can be taken away from the side of the machine frame 1. A resulting board (not shown) slidable in the lateral and longitudinal direction is disposed to focus the image of the original *a* correctly on the copying paper 2. The copying paper 2 which has been charged and light-exposed in the position-regulated state by this regulating board is then forwarded to the copying paper transfer passage *b* by a roller 118 disposed above the copying paper-supporting stand 115, which is driven development passage-selecting mechanisms are independently disposed to select corresponding development passages and guide copying papers to the selected development passages, any of the foregoing copies can be obtained assuredly with great ease, and the versatile electrostatic copying machine of this invention can overcome effectively problems of color mingling and paper jamming which are involved in conventional copying machines.

Various modifications can be made to the copying machine of this invention as far as they do not deviate from the principal technical concept of this invention.

For instance, though in the copying machine shown in FIG. 1 the manual paper feeding system is adopted, it will be apparent to those skilled in the art that an automatic system for feeding sheetlike copying papers, which is known in the art, can be adopted instead of the manual feeding system.

Further, it is possible to adopt a light exposure system such as shown in FIG. 14 instead of the light exposure system where an original to be copied and a copying paper are moved synchronously for the light exposure while the optical system is fixed. In the embodiment shown in FIG. 14, the optical system is moved for the light exposure while both the original and copying paper are kept stationary. This embodiment will now be described.

By referring to FIG. 14, in the interior of the machine frame 1 a copying paper transfer passage *b* is disposed to guide a copying paper 2 from a stand 115 for supporting a copying paper 1 in the stationary state to a development device zone indicated as a whole by referential numeral 6 and a drying or fixing device zone 7. A transparent plate 16 for supporting an original *a* thereon and intermittently. This forwarding roller 118 is engaged with a drive mechanism (not shown) in the machine and receives a driving force therefrom, and this engagement with the drive mechanism can optionally be released.

As in the machine shown in FIG. 1, the development device zone 6 includes a plurality of independent development passages 56*a*, 56*b*, 56*c* and 56*d* and development passage-selecting mechanisms 57*a*, 57*b*, 57*c* and 56*d* for selecting optional one of these development passages 56*a*, 56*b*, 56*c* and 56*d* and guiding the copying paper 2 carrying an electrostatic latent image formed thereon into the so selected development passage. These development passages 56*a*, 56*b*, 56*c* and 56*d* are disposed to overlap one another in the horizontal direction. The copying paper transfer passage *b* is disposed to extend in the vertical direction to introduce the copying paper carrying the electrostatic latent image thereon into any of the development passages. This copying paper transfer passage *b* includes pairs of driving rollers 12*a* and 12*a*', 12*b* and 12*b*', 12*c* and 12*c*', and 12*d* and 12*d*' disposed to confront respective development passages, and confronting guide plates 58*a* and 58*a*', 58*b* and 58*b*', 58*c* and 58*c*', and 58*d* and 58*d*' disposed between respective pairs of the drive rollers.

The developed copying paper forwarded from the development passage is guided to the drying or fixing device zone 7 by a copying paper transfer system 119 including a group of driving rollers and a belt, so that a copying paper discharged from any of the development passage can be passed through this drying or fixing device zone 7 and discharged outside the machine from a single discharge outlet 120.

In the copying machine shown in FIG. 14, the copying operation can be conducted in the same manner as in the copying machine shown in FIG. 1.

What we claim is:

1. A versatile electrostatic copying machine comprising an illuminating zone for illuminating an original to be copied in the stationary or moving state by a light source, a light exposing zone for light-exposing imagewise a statically charged photosensitive layer, an optical system for optically connecting said illuminating zone with said light exposing zone and projecting an image of the original on the photosensitive layer and a development mechanism for developing an electrostatic latent image formed on the photosensitive layer directly or after it has been transferred onto a transfer paper, wherein said optical system comprises a light-selecting mechanism for selecting an optional light from white light and color-separated lights and exposing the photosensitive layer to said selected light and an exposure light quantity-adjusting mechanism for adjusting the exposure light quantity to an optimum quantity with respect to each of a plurality of said light, the development mechanism comprises a development operation-selecting mechanism for selecting an optional development operation among a plurality of development operations differing in the toner hue, said light-selecting mechanism and development operation-selecting mechanism are actuated independently or in the state interlocked with each other so that a copy having a desired coloring effect can be obtained, and said development mechanism comprises a plurality of independent development passages differing in the hue of a toner to be applied to an electrostatic latent image formed on a copying paper, each development passage including a developing toner draw-up mechanism for feeding a developing toner to the development passage, and a plurality of development passage-selecting mechanisms for selecting one corresponding development passage among a plurality of said development passages and guiding a copying paper having an electrostatic latent image formed thereon into said selected development passage.

2. A versatile electrostatic copying machine set forth in claim 1 wherein a plurality of said development passages are disposed to overlap one another in the horizontal direction and a copying paper transfer passage for introducing a copying paper having an electrostatic latent image formed thereon into any of said development passages is disposed to extend in the vertical direction, and each development passage-selecting mechanism is disposed at a point where the extension line of the corresponding development passage on the introduction side intersects the copying paper transfer passage.

3. A versatile electrostatic copying machine set forth in claim 1 wherein each development passage-selecting mechanism includes a guide member pivotally fixed on the machine frame, a solenoid mechanism and a link mechanism for connecting said solenoid mechanism to said guide member and pivoting the guide member on actuation of said solenoid mechanism, and said guide member is disposed at such a position that when the solenoid is in the non-actuated state, the guide member does not cross the vertical copying paper transfer passage but crosses the extension line of the corresponding development passage, and that when the solenoid mechanism is in the actuated state, the guide member crosses the vertical copying paper transfer passage but does not cross the extension line of the corresponding development passage.

4. A versatile electrostatic copying machine set forth inn claim 3 wherein in the vertical copying paper transfer passage, a pair of driving rollers are disposed above each guide member and in the vicinity thereof.

5. A versatile electrostatic copying machine set forth in claim 3 wherein each solenoid mechanism is connected to an electric source through a change-over switch and the solenoid mechanism selects one corresponding development passage among a plurality of development passages when actuated by change-over of said change-over switch.

6. A versatile electrostatic copying machine set forth in claim 5 wherein each developing toner draw-up mechanism is connected to the contact of said change-over switch in parallel with the solenoid of the corresponding development passage-selecting mechanism and is interlocked with actuation of said development passage-selecting mechanism so that only the developing toner draw-up mechanism of the selected development passage is selectively actuated.

7. A versatile electrostatic copying machine set forth in claim 3 wherein the development passage for applying a black toner is disposed at the uppermost position among the development passages.

8. A versatile electrostatic copying machine set forth in claim 1 wherein a single drying or fixing zone is provided in the machine frame and a copying transfer mechanism is disposed to introduce a copying paper discharged from any of the development passages into said drying or fixing zone.

9. A versatile electrostatic copying machine set forth in claim 1 wherein said light-selecting mechanism comprises a light-separating mechanism including a supporting frame disposed to cross an optical path of the optical system and a plurality of color-separating filters attached to said supporting frame and a color-separating filter-selecting mechanism for causing displacement in said supporting frame so as to place it on said optical path, and said exposure light quantity-adjusting mechanism comprises a variable iris mechanism disposed to cross the optical path of the optical system, a cam mechanism interlocked with said color-separating filter-selecting mechanism to hold a cam follower at a prescribed position in correspondence with the selected color-separating filter, and a connecting mechanism for changing the degree of opening of said iris mechanism in correspondence with the displacement of said cam follower.

10. A versatile electrostatic copying machine set forth in claim 9 wherein a filter-free opening is mounted on said supporting frame in addition to said color-separating filter.

11. A versatile electrostatic copying machine set forth in claim 9 wherein a plurality of said development passages are disposed to overlap one another in the horizontal direction and a copying paper transfer passage for introducing a copying paper having an electrostatic latent image formed thereon into any of said development passages is disposed to extend in the vertical direction, and each development passage-selecting mechanism is disposed at a point where the extension line of the corresponding development passage on the introduction side intersects the copying paper transfer passage; each development passage-selecting mechanism includes a guide member pivotally fixed on the machine frame, a solenoid mechanism and a link mechanism for connecting said solenoid mechanism to said guide member and pivoting the guide member on actuation of said solenoid mechanism, and said guide member is disposed at such a position that when the solenoid is in the non-actuated state, the guide member does not cross the vertical copying paper transfer passage but crosses the extension line of the corresponding development passage, and that when the solenoid mechanism is in the actuated state, the guide member crosses the vertical copying paper transfer passage but does not cross the extension line of the corresponding development passage; each solenoid mechanism is connected to an electric source through a change-over switch and the solenoid mechanism selects one corresponding development passage among a plurality of development passages when actuated by change-over of said change-over switch; and wherein a first rotation shaft for rotating said change-over switch and a second common rotation shaft for rotating the supporting frame of said light-selecting mechanism and the cam of said exposure light-adjusting mechanism are coaxially disposed so that they can be rotated independently or in the interlocked state, and a dial member for indicating a developing toner is mounted on said first rotation shaft for the change-over switch and another dial member for indicating a light to be selected is mounted on the second common rotation shaft, said two dial members being disposed so that they can freely be engaged with each other and be released from the engagement.

12. A versatile electrostatic copying machine set forth in claim 9 wherein said color-separating filter-selecting mechanism comprises a dial member disposed outside the machine frame so that it can be turned to indicate a prescribed mark of a light to be selected, and a member for connecting said supporting frame to said dial member, wherein the displacement of said supporting frame is caused by turning of the dial member.

13. A versatile electrostatic copying machine set forth in claim 1 wherein said supporting frame includes a disc-like rotor mounted on the machine frame so that it can rotate around a shaft.

14. A versatile electrostatic copying machine set forth in claim 1 wherein said supporting frame is slidably supported on a rail.

15. A versatile electrostatic copying machine set forth in claim 1 wherein said light-selecting mechanism comprises a light-separating mechanism including a supporting frame disposed to cross an optical path of the optical system and a plurality of color-separating filters and a filter-free opening mounted on said supporting frame and a color-separating filter-selecting mechanism for causing displacement in said supporting frame so as to place it on said optical path, and said exposure light-adjusting mechanism includes an exposure light-adjusting circuit for controlling the light quantity of a light source for light exposure, said exposure light-adjusting circuit being a phase control circuit interlocked with said color-separating filter-selecting mechanism.

16. A versatile electrostatic copying machine set forth in claim 15 wherein said phase control circuit has a lamp-lighting circuit including a group of fixed resistances corresponding to respective lights to be selected by the color-separating filter-selecting mechanism and being capable of being changed over by a change-over switch and a variable resistance for fine adjustment of the quantity of exposure light connected in series to said fixed resistances, and the resistivity value of each fixed resistance is so set that an optimum illuminating power can be obtained in correspondence with the selected light.

17. A versatile electrostatic copying machine set forth in claim 15 wherein position-detecting switch mechanisms corresponding to respective lights to be selected by the color-separating filter-selecting mechanism are disposed on at least one of said supporting frame and the corresponding part of the machine frame, each position-detecting switch mechanism being actuated when it detects that the corresponding color-separating filter or filter-free opening arrives at the position crossing the optical path of the optical system, said supporting frame is connected to a driving mechanism for causing displacement in said supporting frame, said color-separating filter-selecting mechanism comprises a group of selection switch mechanisms which are changed over and actuated in correspondence with the number of lights to be selected by the color-separating filter-selecting mechanism, and said driving mechanism is connected to an electric source through normally closed contacts of said position-detecting switch mechanisms and through said selection switch mechanisms.

18. A versatile electrostatic copying machine set forth in claim 15 wherein said development mechanism comprises a plurality of independent development passages differing in the hue of a toner to be applied to an electrostatic latent image formed on a copying paper, each development passage including a developing toner draw-up mechanism for feeding a developing toner to the development passage, and a plurality of development passage-selecting mechanisms for selecting one corresponding development passage among a plurality of said development passages and guiding a copying paper having an electrostatic latent image formed thereon into said development passage; a plurality of said development passages are disposed to overlap one another in the horizontal direction and a copying paper transfer passage for introducing a copying paper having an electrostatic latent image formed thereon into any of said development passages is disposed to extend in the vertical direction, and each development passage-selecting mechanism is disposed at a point where the extension line of the corresponding development passage on the introduction side intersects the copying paper transfer passage; each development passage-selecting mechanism includes a guide member pivotally fixed on the machine frame, a solenoid mechanism and a link mechanism for connecting said solenoid mechanism to said guide member and pivoting the guide member on actuation of said solenoid mechanism, and said guide member is disposed at such a position that when the solenoid is in the non-actuated state, the guide member does not cross the vertical copying paper transfer passage but crosses the extension line of the corresponding development passage, and that when the solenoid mechanism is in the actuated state, the guide member crosses the vertical copying paper transfer passage but does not cross the extension line of the corresponding development passage; each solenoid mechanism is connected to an electric source through a development passage change-over switch and the solenoid mechanism selects one corresponding development passage among a plurality of development passages when actuated by change-over of said change-over switch; said phase control circuit has a lamp-lighting circuit including a group of fixed resistances corresponding to respective lights to be selected by the color-separating filter-selecting mechanism and being capable of being changed over by an exposure light quantity change-over switch and a variable resistance for fine adjustment of the quantity of exposure light connected in series to said fixed resistances, and the resistivity value of each fixed resistance is so set that an optimum illuminating power can be obtained in correspondence with the selected light; position-detecting switch mechanisms corresponding to respective lights to be separated by the color-separating filter-selecting mechanism are disposed on at least one of said supporting frame and the corresponding part of the machine frame, each position-detecting switch mechanism being actuated when it detects that the corresponding color-separating filter or filter-free opening arrives at the position crossing the optical path of the optical system, and said supporting frame is connected to a driving mechanism for causing displacement in said supporting frame; said color-separating filter-selecting mechanism comprises a group of selection switch mechanisms which are changed over and actuated in correspondence with the number of lights to be selected by the color-separating filter-selecting mechanism, and said driving mechanism is connected to an electric source through normally closed contacts of said position-detecting switch mechanisms and through said selection switch mechanisms; and wherein a first rotation shaft for rotating said development passage change-over switch and a second common rotation shaft for rotating the exposure light quantity change-over switch and the light-selecting switch mechanism are coaxially disposed so that they can be rotated independently or in the interlocked state, and a dial member for indicating a developing toner is mounted on said first rotation shaft and another dial member for indicating a light to be selected is mounted on the second common rotation shaft, said two dial members being disposed so that they can freely be engaged with each other and be released from the engagement.

19. A versatile electrostatic copying machine comprising an illuminating zone for illuminating an original to be copied in the stationary or moving state by a light source, a light exposing zone for light-exposing imagewise a statically charged photosensitive layer, an optical system for optically connecting said illuminating zone with said light-exposing zone and projecting an image of the original on the photosensitive layer and a development mechanism for developing an electrostatic latent image formed on the photosensitive layer directly or after it has been transferred onto a transfer paper, wherein said optical system comprises a light-selecting mechanism for selecting an optical light from white light and color-separated lights and exposing the photosensitive layer to said selected light and an exposure light quantity-adjusting mechanism for adjusting the exposure light quantity to an optimum quantity with respect to each of a plurality of said lights, the development mechanism comprises a development operation-selecting mechanism for selecting an optional development operation among a plurality of development operations differing in the toner hue, said light-selecting mechanism and development operation-selecting mechanism are actuated independently or in the state interlocked with each other so that a copy having a desired coloring effect can be obtained, said light-selecting mechanism comprises a light-separating mechanism including a supporting frame disposed to cross an optical path of the optical system and a plurality of color-separating filters and a filter-free opening mounted on said supporting frame and a color-separating filter-selecting mechanism for causing displacement in said supporting frame so as to place it on said optical path, and said exposure light quantity-adjusting mechanism includes an exposure light-adjusting circuit for controlling the light quantity of a light source for light exposure, said exposure light-adjusting circuit being a phase control circuit interlocked with said color-separating filter-selecting mechanism.

* * * * *